US011317650B2

(12) United States Patent
Findling et al.

(10) Patent No.: US 11,317,650 B2
(45) Date of Patent: May 3, 2022

(54) MANUAL VALVE MECHANISM FOR SMOKING DEVICES

(71) Applicants: Keith Findling, Salt Lake City, UT (US); Samuel Tresco, Salt Lake City, UT (US); Thomas Watson, Salt Lake City, UT (US)

(72) Inventors: Keith Findling, Salt Lake City, UT (US); Samuel Tresco, Salt Lake City, UT (US); Thomas Watson, Salt Lake City, UT (US)

( * ) Notice: Subject to any disclaimer, the term of this patent is extended or adjusted under 35 U.S.C. 154(b) by 118 days.

(21) Appl. No.: 16/845,711

(22) Filed: Apr. 10, 2020

(65) Prior Publication Data

US 2020/0323261 A1 Oct. 15, 2020

Related U.S. Application Data

(60) Provisional application No. 62/832,341, filed on Apr. 11, 2019.

(51) Int. Cl.
*A24F 1/30* (2006.01)
*A24F 5/04* (2006.01)

(52) U.S. Cl.
CPC . *A24F 1/30* (2013.01); *A24F 5/04* (2013.01)

(58) Field of Classification Search
CPC ..... A24F 5/04
See application file for complete search history.

(56) References Cited

U.S. PATENT DOCUMENTS

2020/0315246 A1* 10/2020 LeNoir ..... A24F 5/00

* cited by examiner

*Primary Examiner* — Michael J Felton
*Assistant Examiner* — Katherine A Will
(74) *Attorney, Agent, or Firm* — Intellectual Strategies

(57) ABSTRACT

A water pipe includes a base container, a down stem disposed on the base container, a downtube configured to be inserted into he down stem, a bowl disposed on an end of the downtube, and an actuation lever. The actuation lever includes a fulcrum, a contact surface on a first side of the fulcrum, and an actuation surface on a second side of the fulcrum. The contact surface is exposed for user contact and configured to pivot toward the base container in response to the user contact. The actuation surface is configured to engage with and exert a lifting force on the bowl in response to the user contact.

14 Claims, 10 Drawing Sheets

MANUAL VALVE MECHANISM FOR SMOKING DEVICES

CROSS REFERENCE TO RELATED APPLICATIONS

This application claims the benefit of U.S. Provisional Application No. 62/832,341, filed on Apr. 11, 2019 which is incorporated by reference herein in its entirety.

SUMMARY

Embodiments described herein relate to water-cooled negative pressure smoking assemblies, frequently called waterpipes, and to the combustion of organic material and subsequent inhalation of the vapor through a filter medium and the manual actuation of a valve controlled airflow system.

Embodiments described herein provide one or more of the following benefits: one handed airflow regulation, user control of the rate of combustion of the organic material being smoked, reduction of the strength and dexterity needed to use a waterpipe.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements.

DETAILED DESCRIPTION

Figure 1:
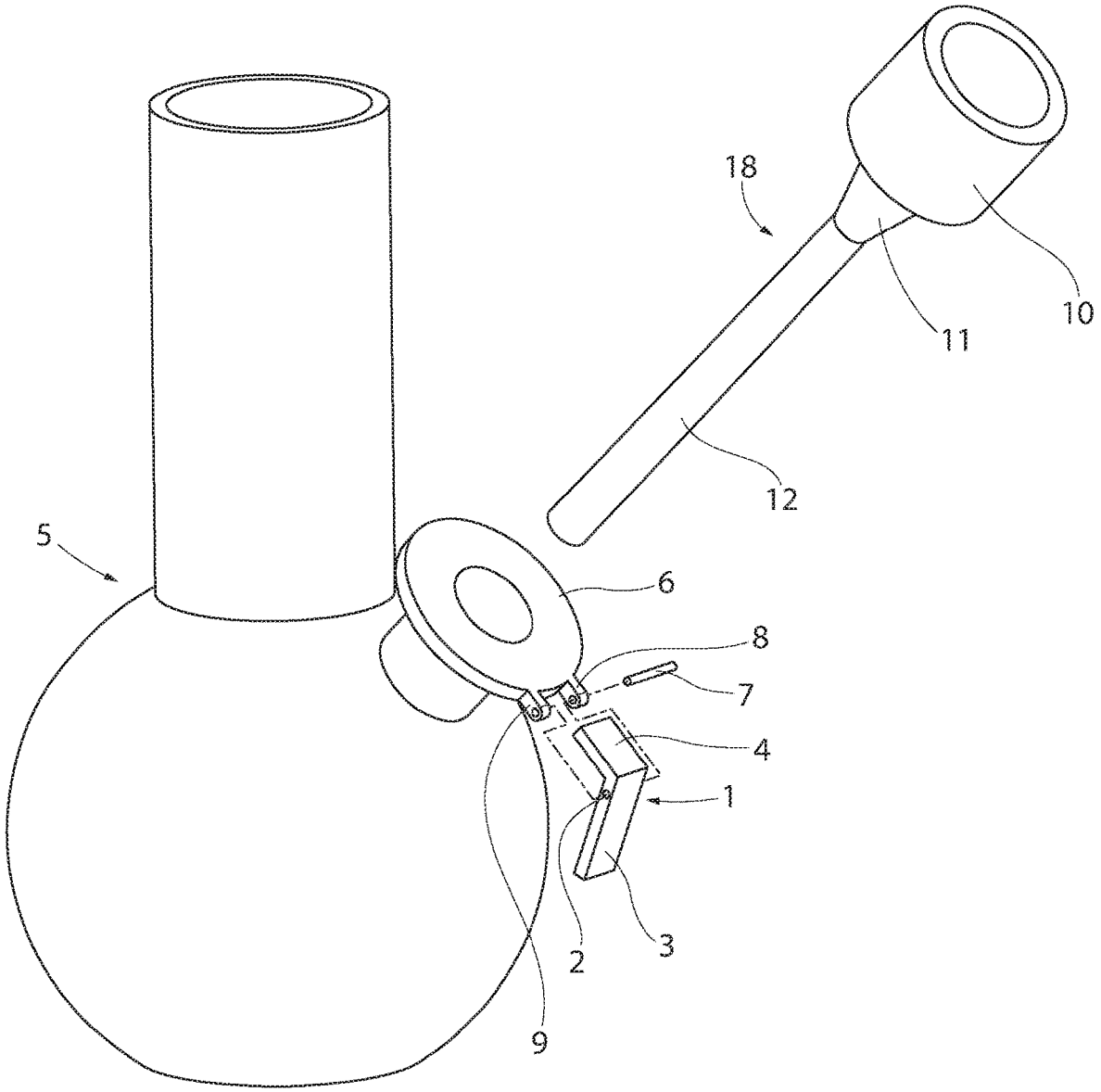
FIG. 1 depicts a top isometric explode view of an embodiment of the assembly components.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

A water pipe is a smoking device used to cool the combusted material before the combusted vapors reach the user's mouth, throat and lungs. Some embodiments described herein provide a simple, manual carburation system that facilitates one-handed use for bypass and combustion temperature control, and do not necessarily require fine motor skills in its operation. In an embodiment, the lever actuated carburetor only requires a point of contact with the bowl piece and a fulcrum. The position of the mounting point is variable. Multiple embodiments are shown and described herein. In one embodiment, the mounting point is at the fulcrum. In another embodiment, the mounting point is at the bowl. In an embodiment, the lever is L-shaped, providing a surface to interface with the bowl piece, and a second surface to act as a finger pad. In the closed position, gravity along with the tapered shape of the bowl hold the combustion chamber in the smoke path, allowing the user to apply heat to the plant material and draw through the waterpipe to fill the waterpipe chamber with smoke. When the finger pad is depressed, the bowl is lifted and enters the open position, or actuation mode, which allows for bypassing the combustion chamber and clearing of the smoke from the waterpipe into the smoker's body. Additionally, because the lever has a range of motion, the smoker can control the amount of bypass applied to the combustion chamber, effectively modulating the draw rate and burn temperature of the plant material.

In an embodiment the lever's finger pad segment may be differentiated from the bowl piece mounting segment by an angle or curve. The lever's finger pad segment may be longer than the bowl piece mounting segment. The lever's finger pad segment may end upturned to act as a finger stop or may end in a continuation of the arc of separation.

FIG. 1 depicts an exploded view of a lever assembly for one embodiment implemented in a waterpipe 5. It illustrates a lever 1 having a uniform body with an obtuse angle above the lever mounting and articulation point 2 that separates the finger pad 3 from the bowl piece actuation segment 4 which interacts with the bottom surface of the bowl 10 to actuate the bowl piece assembly 18 comprised of the bowl 10, angle of taper 11, and downtube 12. The lever attaches to the down stem 6 by means of a pivot pin 7 piercing the down stem 6 at points 8 and 9 and the lever 1 at hole 2. For the purposes of illustration, the pivot pin 7 is signified within the drawings as the attachment method. However, other means of joining can be utilized and implemented and attached to other known means of connecting two physical structures, such as a hinge, flexible joint, or fitment where the two protrusions 8, 9 have inward facing male projections that meet up with hole 2 on lever 1. The bowl piece assembly 18 is comprised of a bowl 10, a tapered joint 11, and a downtube 12. In an embodiment a bowl piece 18 is consisting solely of or is comprising a combination of known and widely used materials formed by current and widely known means of fabrication. In general, specific characteristics of the bowl piece 18 are determined by the existence of a bowl 10, the angle of taper 11 by which the bowl piece 18 mates with the down stem 6, and the length by which its downtube 12 continues into the waterpipe 5.

Figure 2:
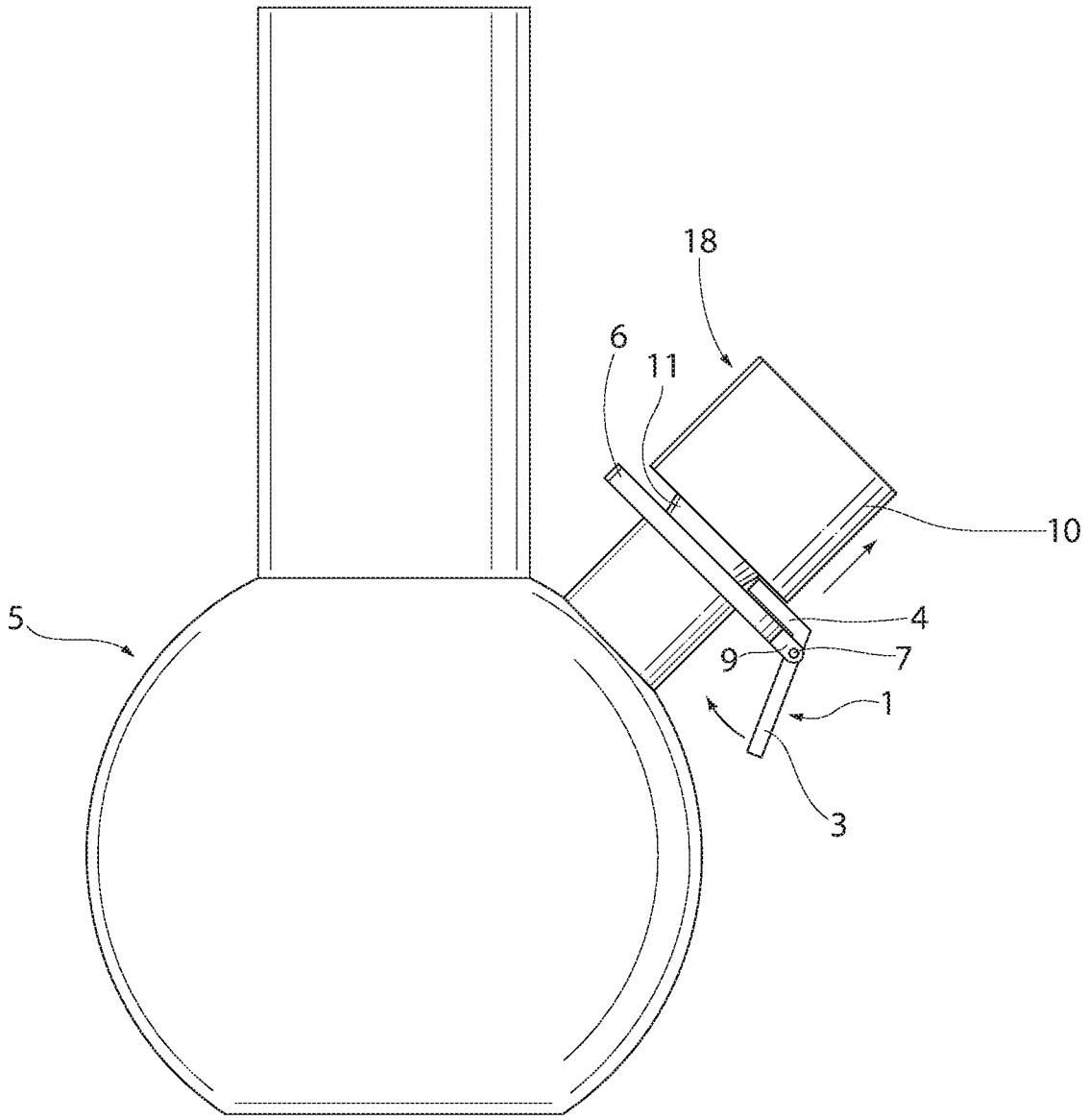
FIG. 2 depicts a side view of an embodiment of the assembly of FIG. 1.
Figure 3:
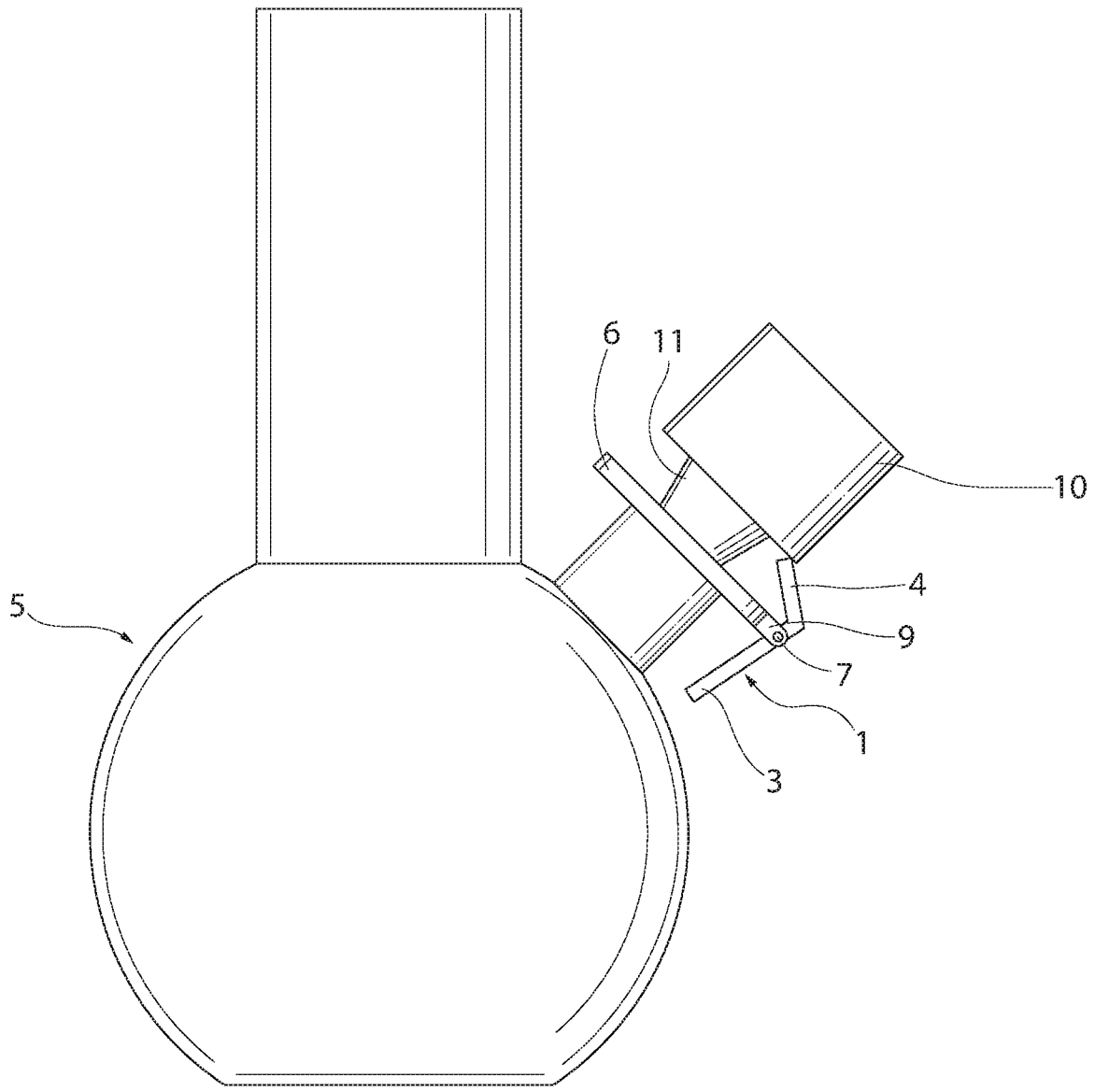
FIG. 3 depicts a side view of an embodiment of the assembly of FIG. 1 in an actuating mode.
Figure 4:
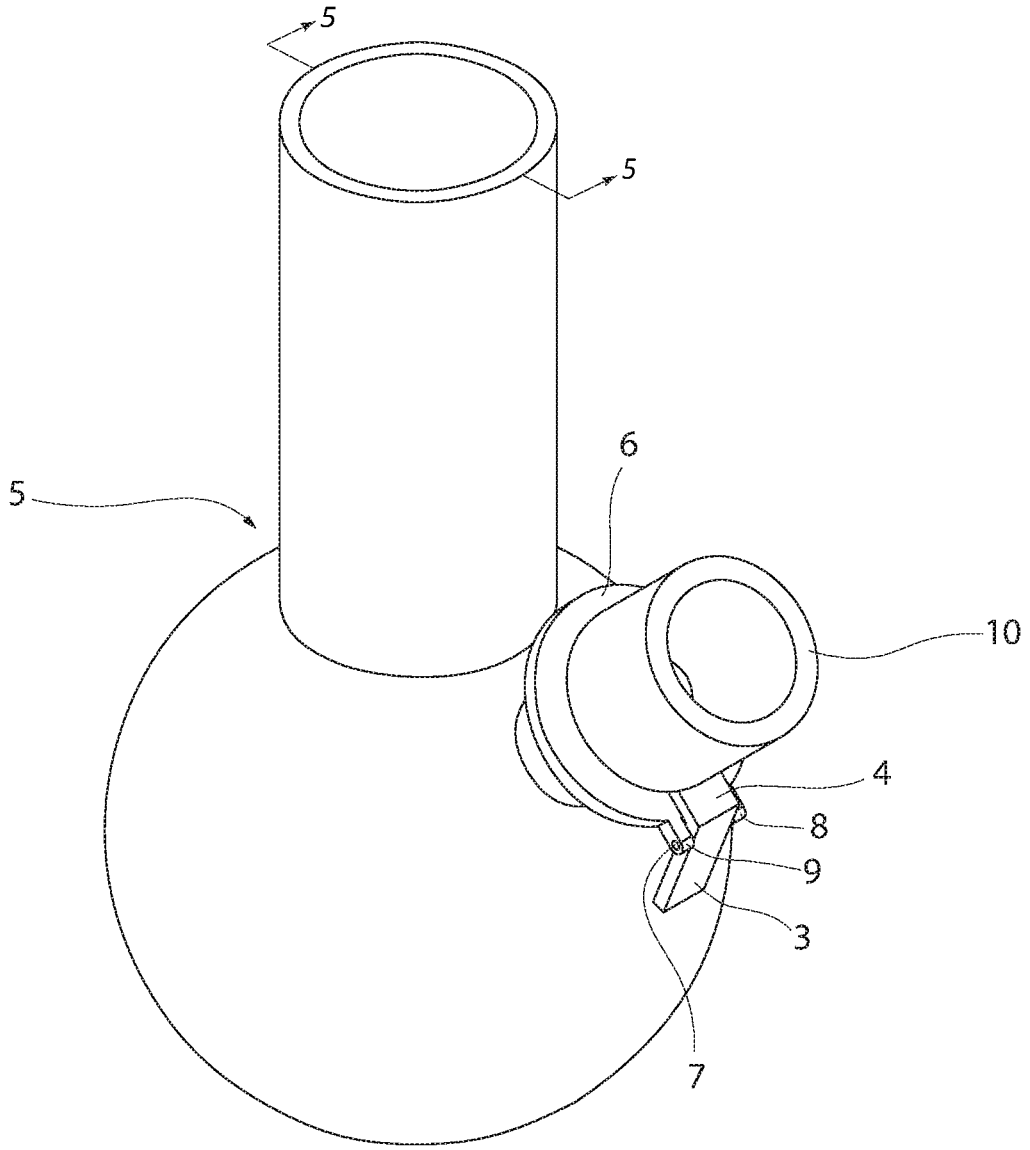
FIG. 4 depicts an isometric view of an embodiment of the assembly of FIG. 1 defining cutaway side views.
Figure 5:
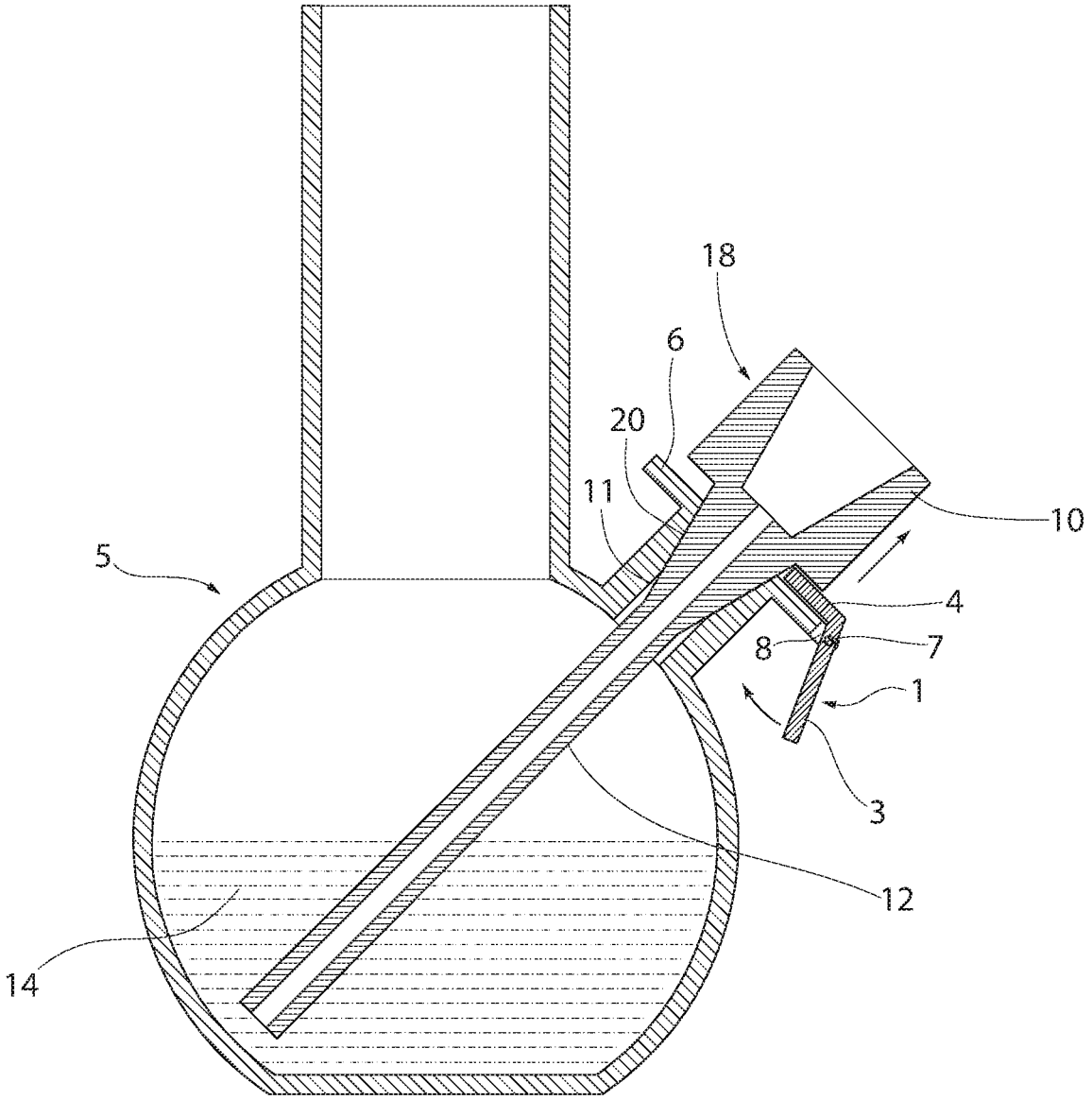
FIG. 5 depicts a cutaway side view of one embodiment of the assembly of FIG. 1.
Figure 6:
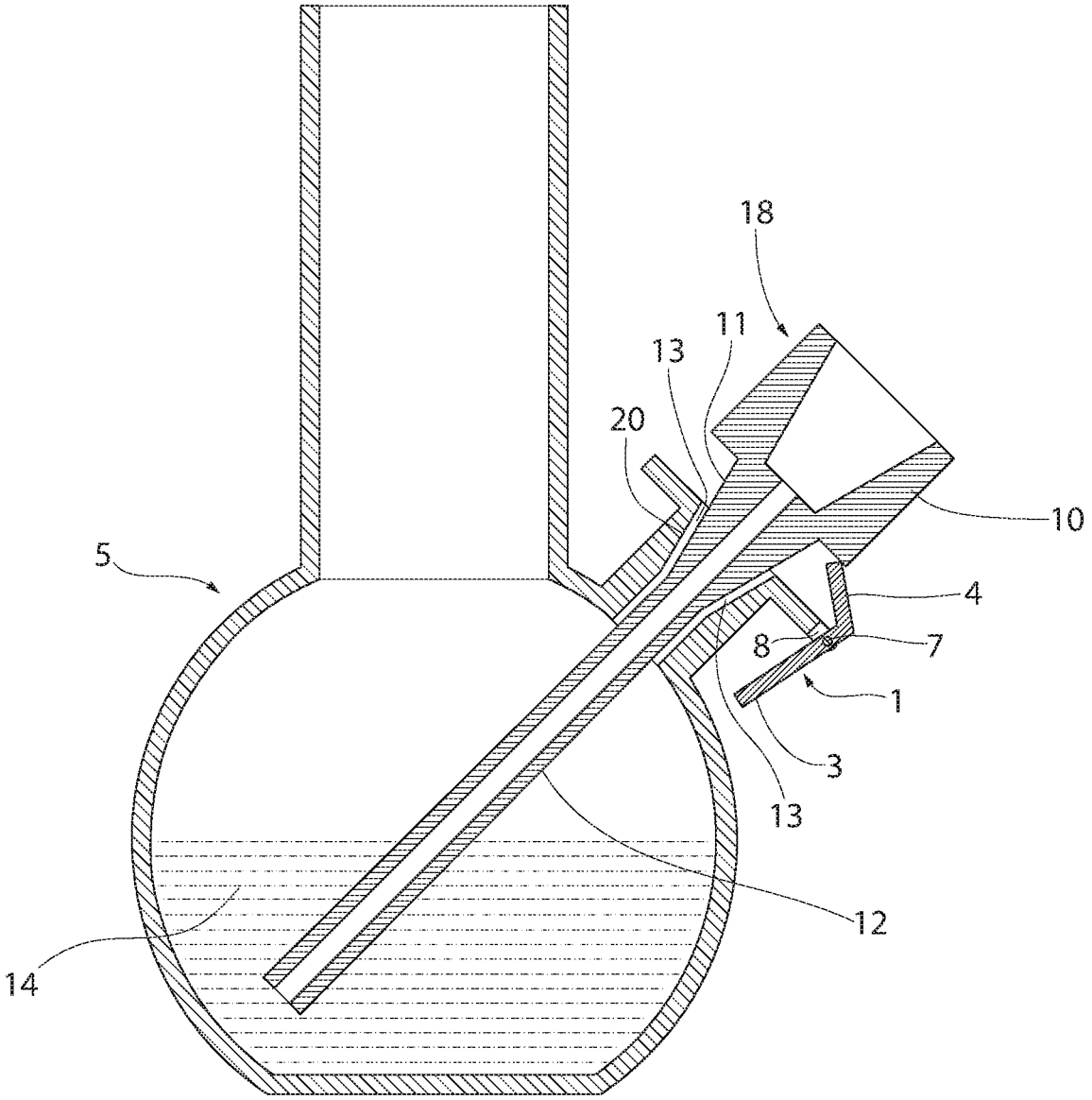
FIG. 6 depicts a cutaway side view of one embodiment of the assembly of FIG. 1 in the actuation mode.

FIG. 2 and FIG. 3 illustrate one embodiment of the assembly with the mechanical actuation of lever 1 and the bowl piece 18 in closed and open carburetion positions, where FIG. 2 illustrates one embodiment of the system at its origin (bowl piece 18 at closed position), and FIG. 3 illustrates one embodiment of the system with the lever fully depressed (bowl piece 18 at open position). The lever 1 pivots around an axis and pivot pin 7, which pierces the lever 1, and the waterpipe at points 8 and 9. The isometric view of an embodiment of the assembly in FIG. 4 defines the cutaway views shown in FIG. 5 and FIG. 6. These figures are the cut-away analogues to FIGS. 2 and 3 respectively and highlight the carburation pathway created by the lever 1's actuation of bowl piece 18. Heat-sink medium 14 is displayed with dashes, and could be liquid, solid, a combination of these, or any material deemed suitable to either cool, filter, or treat in any way the smoke passing through. In some waterpipes, the role of the downtube 12 is fulfilled by the down stem 6. FIG. 6 shows the carburation pathway 13 provided by the mechanical actuation of bowl piece 18, and the separation of tapered male joint 11 with its companion tapered female joint 20 on the down stem 6.

Figure 7:
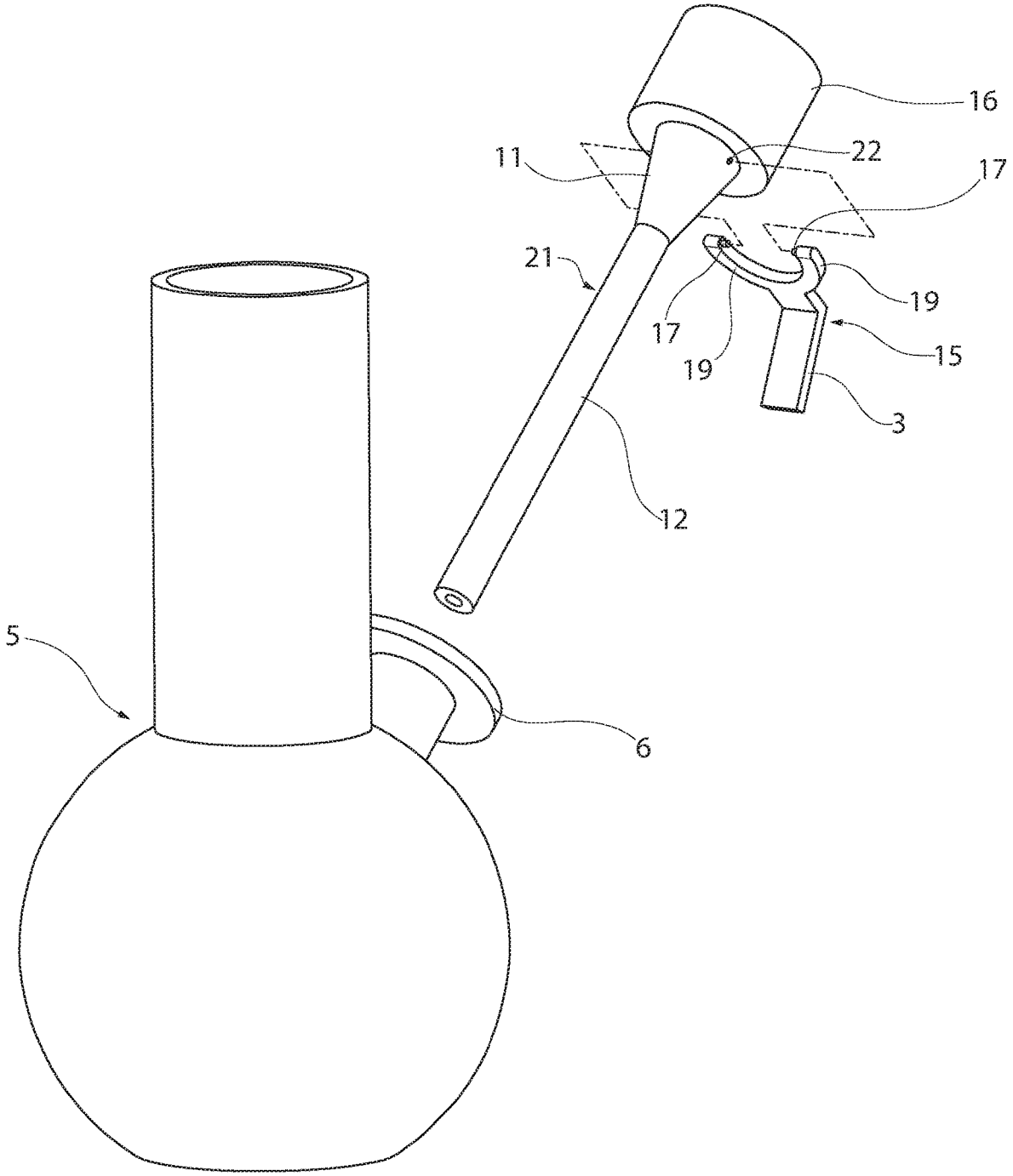
FIG. 7 depicts an explode view of a further embodiment of the assembly.

FIG. 7 depicts a further embodiment that achieves the same mechanical actuation by way of joining a different type of lever 15 to a modified bowl piece 21 instead of to the down stem 6. FIG. 7 illustrates the lever 15 having of a uniform body with an obtuse angle that separates the finger pad 3 from the bowl piece actuation segment 4. The lever mounting points 17 are male protrusions that connect to the bowl piece mounting points 22 and are held in place by the pressure provided from the lever prongs 19. As compared to bowl piece 18, bowl piece 21 has the same or similar geometries, and only differs by the addition of mounting points 22 which allow for the alternate carburation action.

In the embodiment illustrated in FIG. 7, attachment of the lever 15 to the bowl piece 21 facilitates rotation of the lever 15 around the axis of the bowl piece 21. Since the bowl piece 21 can rotate axially within the down stem 6, the lever 15 can also rotate relative to the down stem 6. This allows a user to easily rotate the bowl piece 21 and the lever 15 into a comfortable angular position anywhere around the down stem 6. In other embodiments, the lever 15 might be attached to the bowl piece 21 in a different manner using other types of connections or actuation structures such as screws, pins, etc. Additionally, the lever 15 might be attached to a different component of the bowl piece 21 such as somewhere other than the tapered male joint, so long as the lever 15 is able to provide an upward force on the bowl piece 21 in response to pressure on the lever 15 by a user.

Figure 8:
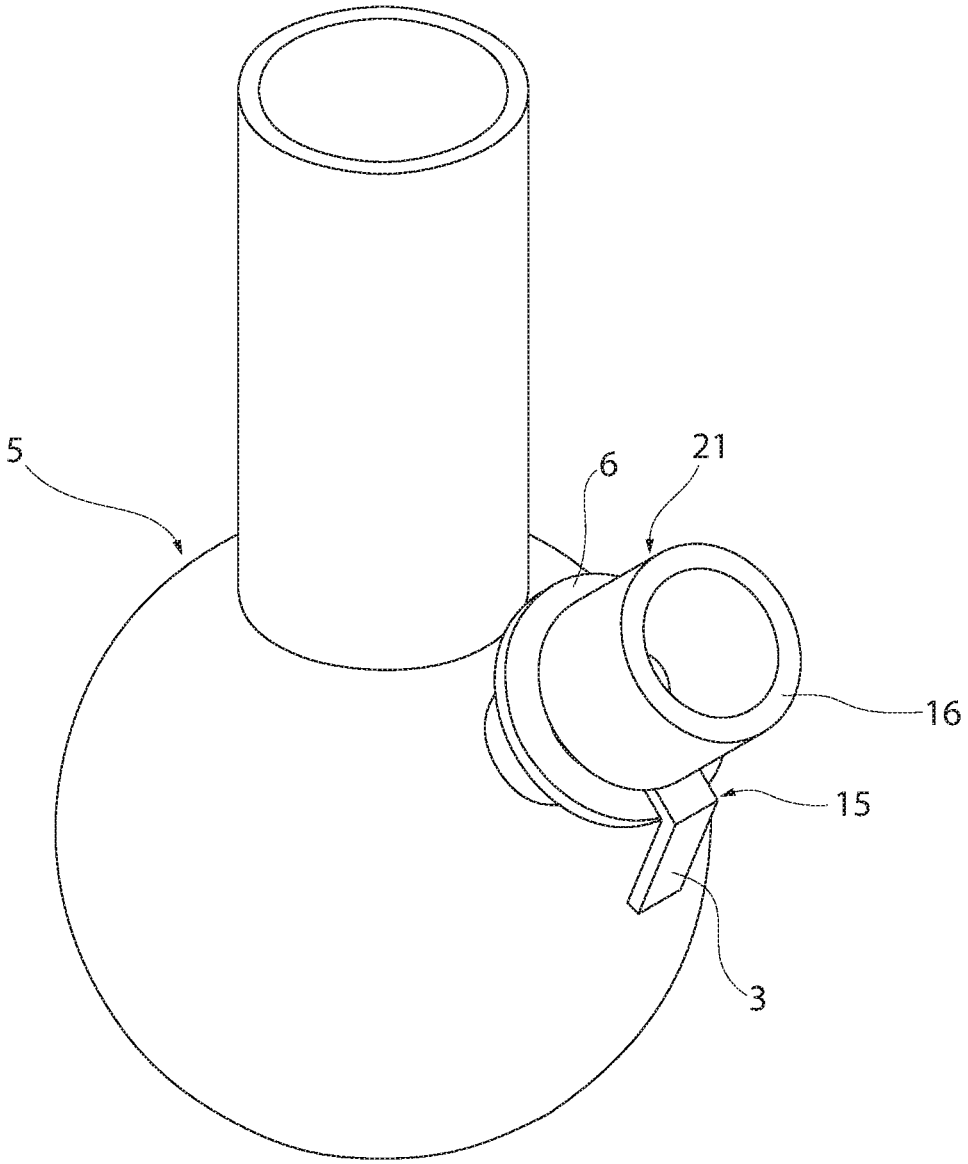
FIG. 8 depicts an isometric view of the embodiment of the assembly shown in FIG. 7.
Figure 9:
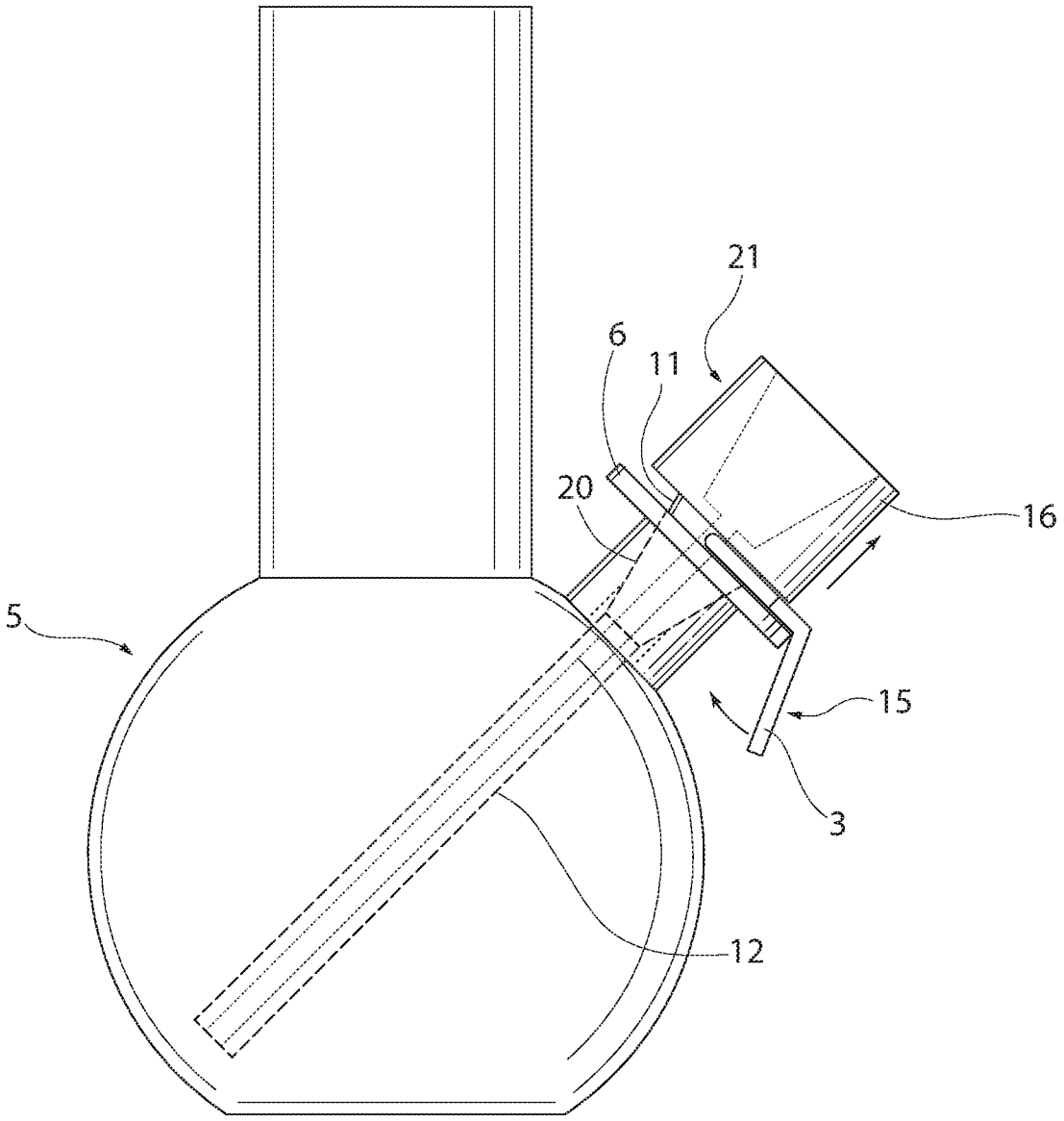
FIG. 9 depicts a side view with interior dotted lines of the embodiment of the assembly shown in FIG. 7.
Figure 10:
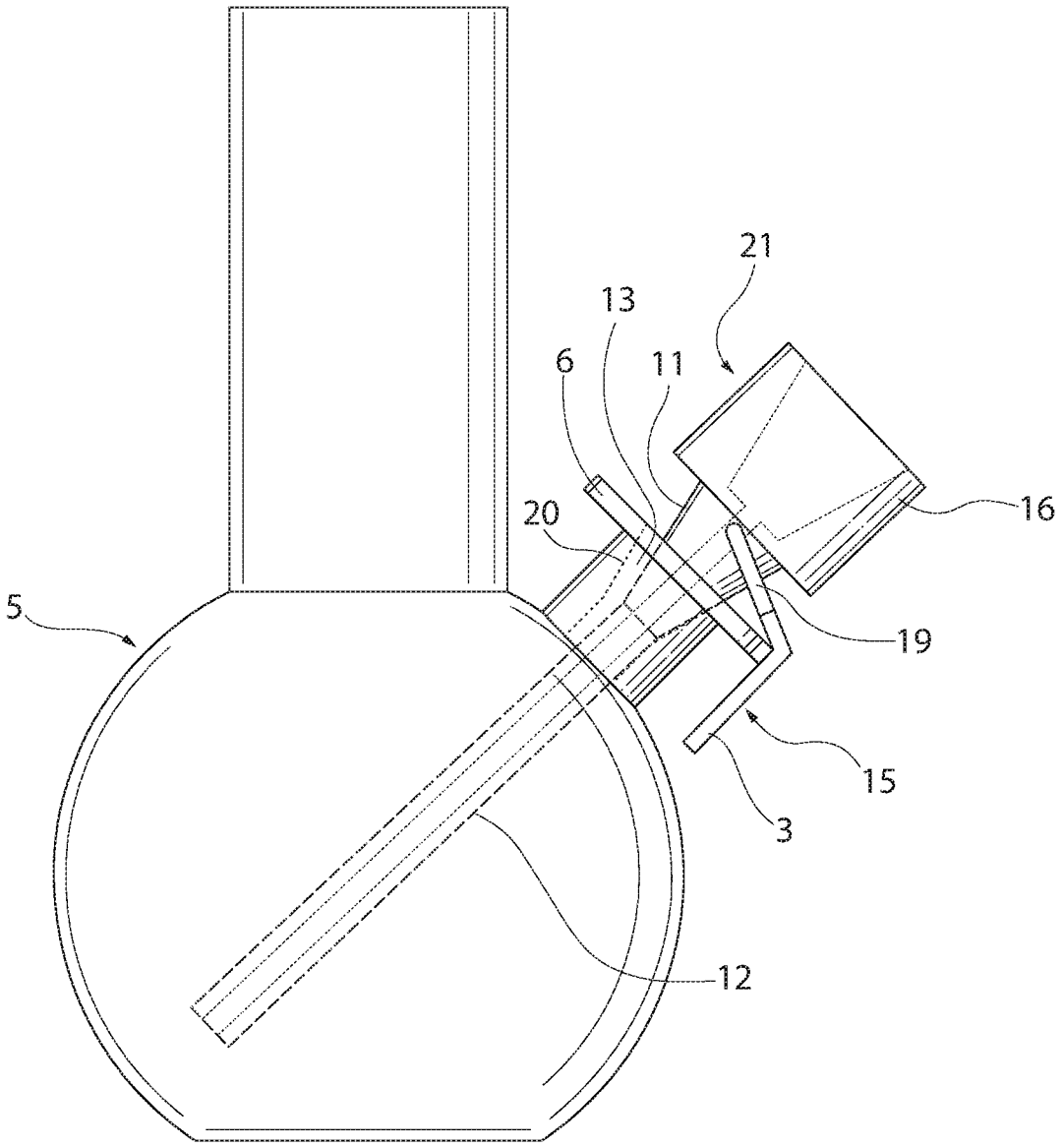
FIG. 10 depicts a side view with interior dotted lines of the embodiment of the assembly shown in FIG. 7 in the actuation mode.

FIG. 8 depicts an isometric view of an embodiment of the lever 15 and bowl piece 21 configured with a waterpipe. FIGS. 9 and 10 illustrate the mechanical actuation the lever 15 provides the bowl piece 21 in a transparent side view. The bowl piece 21 is comprised of a bowl 16, a tapered joint 11, and a downtube 12. In an embodiment a bowl piece 21 is consisting solely of or is comprising a combination of known and widely used materials formed by current and widely known means of fabrication. In general specific characteristics of the bowl piece 21 are determined by the existence of a bowl 16, the angle of taper 11 by which the bowl piece 21 mates with the down stem 6, and the length by which its downtube 12 continues into the waterpipe 5. FIG. 9 depicts an embodiment of the system at its origin, and FIG. 10 depicts an embodiment of the system with the lever fully engaged. Highlighted by FIG. 10 is the carburation pathway 13 created by the lever 15's actuation of bowl piece 21 and its separation of tapered male joint 11 with its companion tapered female joint 20 on the down stem 6.

A water-cooled negative pressure smoking assembly that provides the benefits and methods of one-handed airflow regulation which subsequently affects the rate of combustion of the organic material via a lever that is attached to the assembly by a variety of embodiments shown herein.

One or more benefits are derived, including but not limited to the following items. The ability of the user to clear the chamber of smoke with the same hand that holds and stabilizes the waterpipe while in use, and to control the burn temperature of the combustible through modulation of airflow with more accuracy and ease. At least one implementation uses a modular assembly allows for various modifications of the design element. The combination and utilization of the new and improved method over prior art gives the advantage of freeing up a user's hand, which by nature makes the design more convenient as compared to existing methods.

In some embodiments, the lever limits the travel of the bowl piece to a maximum while the bowl's down stem still remains within the bounds of the waterpipe so that if the user's finger slips, the bowl piece slides gently back to its original position. This has a cost saving effect to the user, as it is common for bowl pieces to be dropped and damaged beyond a useable condition.

In some embodiments, the combustion chamber includes a long, tapered exterior measured as an acute angle from its intersection with the down stem. Some embodiments also include a mounting point for the lever, either on the bowl piece or at the fulcrum. Some embodiments also include a fulcrum for the lever, built into the shape of the waterpipe or down stem so as to be able to be added on to an existing waterpipe. In some embodiments, a long tube continuing after the taper keeps the bowl secured by the down stem when in the open position.

In further embodiments, a carburation mechanism for smoking devices includes a lever and a bowl piece. The lever is configured to manually actuate the bowl piece. In some embodiments, a fulcrum of the lever is not limited to one radial position around the down stem and/or the downtube and/or the bowl and/or the waterpipe. As the lever is affixed to the bowl piece, the fulcrum can be any point on a circular perimeter of a body that is either part of the waterpipe or acts as a connection between the waterpipe and bowl piece.

Although the operations of the method(s) herein are shown and described in a particular order, the order of the operations of each method may be altered so that certain operations may be performed in an inverse order or so that certain operations may be performed, at least in part, concurrently with other operations. In a further embodiment, instructions or sub-operations of distinct operations may be implemented in an intermittent and/or alternating manner. Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A water pipe comprising:

a base container;

a down stem disposed on the base container;

a downtube configured to be inserted into the down stem;

a bowl disposed on an end of the downtube; and an actuation lever comprising:

a fulcrum;

a contact surface on a first side of the fulcrum, wherein the contact surface is exposed for user contact and configured to pivot toward the base container in response to the user contact; and an actuation surface on a second side of the fulcrum, wherein the actuation surface is configured to engage with and exert a lifting force on the bowl in response to the user contact, wherein the actuation lever is rigid and wherein the contact surface and the actuation surface form an angle such that the contact surface and the actuation surface are not coplanar and do not form parallel planes.

2. The water pipe of claim 1, wherein the actuation lever further comprises an articulation point to connect the lever to the downtube or to a tapered joint coupled to the bowl.

3. The water pipe of claim 1, wherein the actuation lever further comprises an articulation point to connect the lever to the down stem or to a lip on the down stem.

4. The water pipe of claim 1, wherein the contact surface and the actuation surface form an obtuse angle.

5. The water pipe of claim 1, wherein the contact surface and the actuation surface form an oblique angle.

6. The water pipe of claim 1, wherein the contact surface and the actuation surface are on a same side of the actuation lever.

7. The water pipe of claim 1, wherein the actuation surface extends circumferentially, at least partially, around the downtube.

8. The water pipe of claim 1, wherein the down stem comprises a lip extending radially out.

9. The water pipe of claim 8, wherein the down stem further comprises a pivot pin, and wherein the actuation lever pivots about the pivot pin, and wherein the pivot pin is the fulcrum.

10. The water pipe of claim 1, wherein the actuation lever comprises a finger pad and a piece actuation segment, and wherein the contact surface is on the finger pad and the actuation surface is on the piece actuation segment.

11. The water pipe of claim 1, wherein the downtube comprises a tapered section near the bowl.

12. The water pipe of claim 11, wherein the down stem comprises a tapered female joint.

13. The water pipe of claim 12, wherein a carburation is formed between the tapered section and the tapered female joint when the actuation lever is pressed down.

14. The water pipe of claim 1, wherein rotation of the actuation lever about the fulcrum is stopped by the actuation lever contacting the downstem.

* * * * *